United States Patent [19]

Bunyard

[11] 4,370,917

[45] Feb. 1, 1983

[54] PISTON-RACK ROTARY ACTUATOR

[76] Inventor: Alan D. Bunyard, 46, Sunnydale Ave., Patcham, Brighton, East Sussex, England

[21] Appl. No.: 166,773

[22] Filed: Jul. 8, 1980

[30] Foreign Application Priority Data

Jul. 14, 1979 [GB] United Kingdom ..... 7924621

[51] Int. Cl.[3] ..... F01B 1/06; F01B 7/04

[52] U.S. Cl. ..... 91/491; 91/186; 92/68; 92/69 A; 92/148

[58] Field of Search ..... 92/69 R, 69 A, 69 B, 92/136, 148, 65, 75, 68; 74/89.12, 422; 91/186, 491

[56] References Cited

U.S. PATENT DOCUMENTS

| | | | |
|---|---|---|---|
| 404,338 | 5/1889 | Blake | 92/68 |
| 2,105,846 | 1/1938 | Ruliancich | 92/148 |
| 2,260,197 | 10/1941 | Seligman | 92/69 R |
| 2,564,363 | 8/1951 | Horowitz | 92/68 |
| 2,642,748 | 6/1953 | Widmer | 92/148 |
| 3,075,504 | 1/1963 | Vogel | 92/148 |
| 3,143,931 | 8/1964 | Worman | 92/136 |
| 3,537,358 | 11/1970 | Bunyard | 92/136 |
| 3,692,005 | 9/1972 | Buske | 92/69 R |
| 3,815,479 | 6/1974 | Thompson | 92/136 |
| 3,987,767 | 10/1976 | Buske | 92/69 R |
| 4,077,267 | 3/1978 | Schottler | 92/148 |
| 4,209,049 | 6/1980 | Regensburger | 74/422 |

FOREIGN PATENT DOCUMENTS

| | | | |
|---|---|---|---|
| 2508861 | 9/1975 | Fed. Rep. of Germany | 92/68 |

*Primary Examiner*—Abraham Hershkovitz

*Attorney, Agent, or Firm*—Irving M. Weiner; Pamela S. Burt; John L. Shortley

[57] ABSTRACT

A piston-rack rotary actuator having four pistons each with an integral rack and each displaceable along a cylinder unique thereto, the racks meshing with a center gear at equiangularly spaced points and causing angular movements of a shaft about its rotational axis when said pistons are displaced along their respective cylinders, said gear being secured to said shaft. The racks are formed in respective webs which are supported by the actuator body in such a manner as to prevent piston-slewing which would otherwise occur due to the separating force generated by the meshing gear and racks when said racks are moved relatively to the gear.

16 Claims, 15 Drawing Figures

PISTON-RACK ROTARY ACTUATOR

This invention relates to a piston-rack rotary actuator.

There are many designs of piston-rack rotary actuators on the market and one kind has a cylinder with two pistons each integral with a rack engaging teeth on a centre gear (see for example Machine Design, Fluid Power Reference Issue 1972–73, pages 44–45). This kind of actuator exhibits a feature which is inherent from the relative dispositions of the racks on the one hand and the centre gear fixed to the output shaft on the other hand, namely, the feature that the teeth of the respective racks mesh with diametrically opposed teeth of the centre gear along lines which are offset from the centres of the pistons. Ignoring the tendency of the meshing teeth to separate when the pistons are moved towards one another under the influence of the pressurised medium, which tendency is considerably reduced when the pistons are moved away from one another, the offset racks on the two pistons leads to slewing or cocking of the pistons in the cylinders.

This slewing or cocking of the pistons has been overcome by the use of parallel rods each of which extends through each of the pistons, said rods positively preventing or at least very significantly reducing any piston cocking movement. However, it is necessary to provide bearings and seals in various places and this increases the cost.

There is also the kind of piston-rack rotary actuator which has four pistons but, in this case, the pistons are joined together in pairs by a connecting bar in which a rack is formed, and the piston pairs are reciprocatable in parallel cylinders (see for example Machine Design, Fluid Power Reference Issue, 1968, page 33). In this arrangement, the respective end chambers of the respective cylinders have pressurised fluid supplied thereto in order to cause the two racks to impart angular movement to a centre gear with which they mesh and which is integral with or secured to an output shaft.

The principal object of the present invention is to try to get away from the disadvantage of piston slewing or cocking whilst, at the same time, not sacrificing power and without increasing the physical dimensions of the actuator by comparison with any existing one which will produce the same power. This object is achieved according to the invention by the provision of four racks whose respective teeth mesh with two sets of diametrically opposed teeth on a centre gear on an output shaft, each rack having a piston and each piston being accommodated in a cylinder unique thereto in the actuator body, a pressurised fluid medium supplied to corresponding one or other faces of said pistons simultaneously resulting in movement of said pistons in four different directions which are perpendicular to one another. Thus, angular movement is imparted to said shaft in one or other direction about its axis.

Such an arrangement of pistons and their racks as described in the preceding paragraph (namely, disposed in a "square" around the centre gear on said shaft) enables the imaginary line which extends through the centre of the respective piston face perpendicularly to said face to extend tangentially to or just through said teeth on the centre gear; this will become apparent when the drawings are described and said arrangement overcomes the problem inherent in the use of offset racks because the pressure applied to the respective piston face is transmitted along a line which goes through the meshed teeth.

In a preferred embodiment, which provides the highest degree of compactness because of the "nesting" of the racks partially within one another in one operating condition of the actuator, each rack is formed in a web which is provided with a passageway extending therethrough, the arrangement being such that, when each piston has been moved to that end of its cylinder which is nearer to the gear on the shaft, a portion of said rack including the free end thereof is accommodated in the passageway of the web which is attached to a neighbouring piston.

However, instead of a passageway in each web, a recess could be provided in each web and said portion of said rack including the free end of said rack could extend into said recess. The effect obtained by the use of this variation (recess instead of a through-passageway) should be as good as that obtained with the arrangement described in the preceding paragraph.

Other arrangements may be possible; thus, for example, the racks may be formed in a web which is bifurcated and approximately Y-shaped, the teeth of said racks being cut in corresponding faces of two parallel limbs of the Y and said limbs being connected at corresponding ends thereof to one end of the stem of the Y, the other end of said stem being connected to the piston. With such a configuration, the "nesting" of the racks is obtained by the parallel limbs of the Y-shaped web of one piston/rack being disposed one on each side of the stem of the next piston/rack of the "square" arrangement of said piston/racks. By way of a further example, the web in which the rack is formed may be shaped to resemble a rather flattened or shallow Z when looked at from the side (as distinct from the back or the front), provided that the roots of the teeth of the rack lie on or very near to a diametral plane of the piston; this cranking of the web means that the web is connected to the piston other than diametrally and this creates a "space" or the beginnings of a "space" into which the portion of the rack, including the free end thereof, of another piston/rack can extend when the pistons have all been moved as far as they can go towards the centre gear on the shaft.

One way of carrying out the present invention will now be described in detail with reference to the accompanying drawings which illustrate two different embodiments by way of example and in which.

Figure 3:
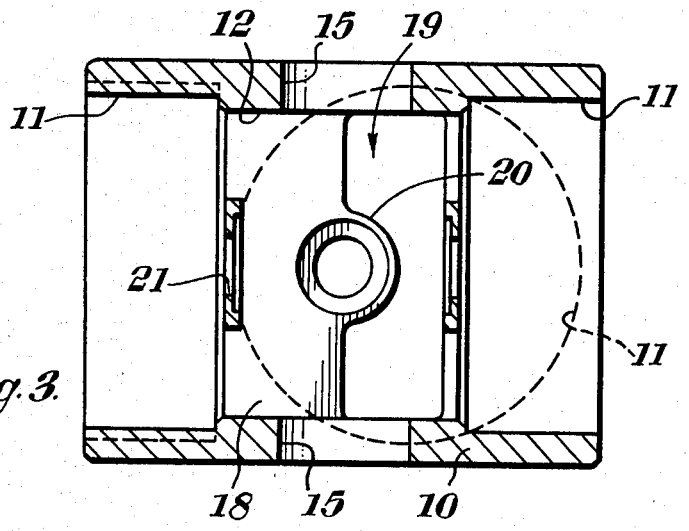
FIG. 3 is a section on the centre line through the casting which constitutes the one-piece body of the actuator.

Referring to the drawings, a casting or body 10 provides four right circular cylinders 11 which partially overlap one another and which have their longitudinal axes coplanar and perpendicular to one another and none of which is in axial alignment with any of the others, said cylinders 11 thereby creating a central cuboidal chamber 12 (FIG. 3). See also FIG. 13 which schematically shows this arrangement of cylinders.

An output shaft 13 is supported by its associated bearings 14 in apertures 15 in opposed walls of said body 10. Said shaft 13 has gear teeth formed therein so as to form a centre gear 16, and also has flats 17 at at least one end thereof. The flats 17 constitute the means whereby the shaft 13 can be connected to a mechanism (for example, a ball valve) which is to be operated by said actuator.

The chamber 12 is bounded by six walls of which two walls have the apertures 15 therein and of which the other four are identical with the one illustrated in FIG. 3. In said Figure, it is seen that the wall 18 is formed with a relatively large opening 19 therein and also has a semi-circular extension 20. Said wall 18, in the region of said extension, is drilled and counterbored to form a seat 21 for a pad (not illustrated) of a suitable synthetic resin material (for example, DELRIN, Registered Trade Mark). The purpose of said pad will be explained later.

Figure 6:
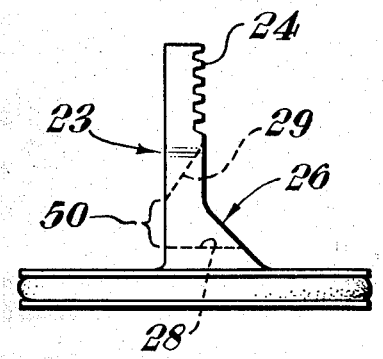
FIGS. 6 and 7 are two views of one combined piston/rack, FIG. 6 showing the side view of said rack and FIG. 7 showing the front view thereof.
Figure 7:
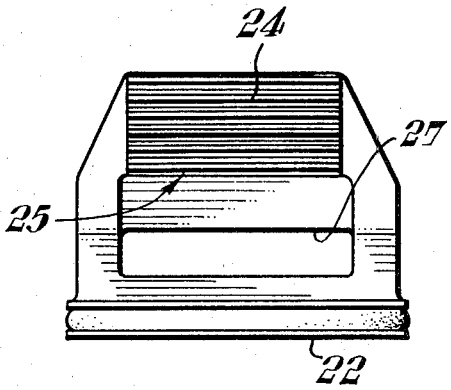
Figure 13:
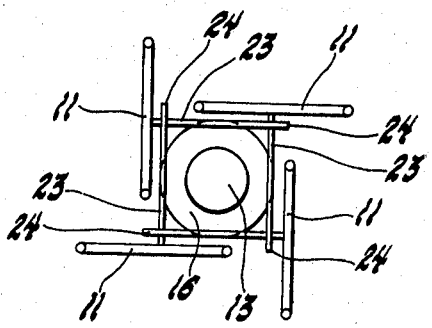
FIG. 13 is a schematic representation of the actuator.

Referring to FIGS. 6, 7 and 13, it will be seen that a piston 22, which is circular when viewed from above, has an integral web 23 in a part of one face of which a toothed rack 24 is provided. The rack extends from the free end of the web 23 as far as a line which is indicated by the reference numeral 25 in FIG. 7. The web 23 has a buttress 26 and the buttressed web has a through passageway 27 having one wall 28 whose surface is parallel to the adjacent face of the piston. Another wall 29, opposite side wall 28, is sloped to form an included angle of approximately 55° with the plane lying on the surface of the wall 28; it is not known at present whether the angle of approximately 55° is critical or not.

Figure 1:
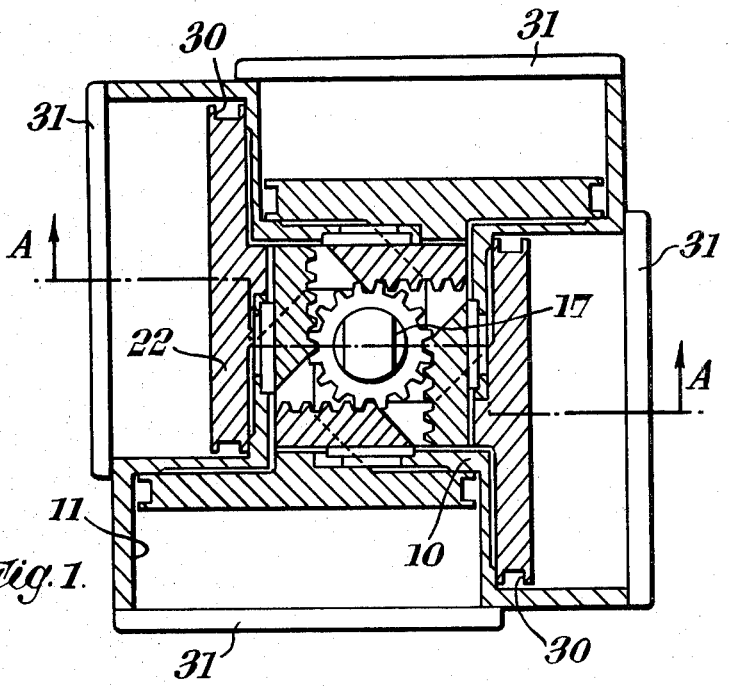
FIG. 1 is a section through one embodiment of a piston-rack rotary actuator of double-acting design according to the present invention, said section having been taken transversely of the output shaft of the actuator.

Turning now to FIG. 1, it will be seen that four pistons and integral racks, each identical with the one illustrated in FIGS. 6 and 7, are located in corresponding ones of their operating conditions. Thus, the teeth of each rack 24 are in mesh with the centre gear 16 and a portion of each rack (including the free end thereof) is accommodated in the passageway 27 in the web 23 of an adjacent piston/rack; in FIG. 1, said portion of any rack which is selected as the starting point is accommodated in the passageway 27 in the web which is integral with that piston which is the next one in a clockwise direction from the piston with which the selected rack is integral.

Figure 2:
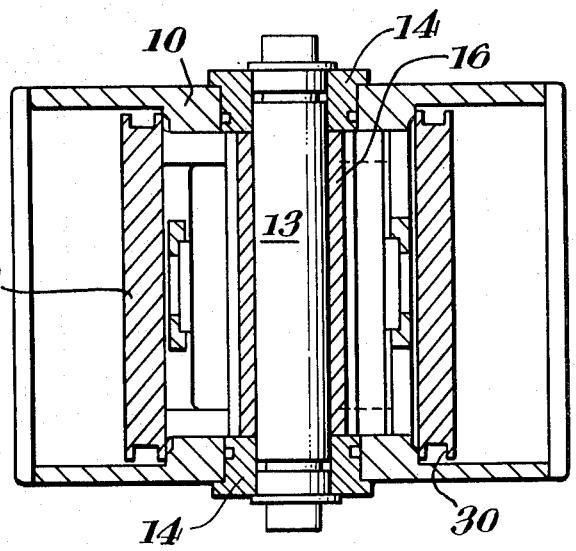
FIG. 2 is a section on the line A—A in FIG. 1.

In FIGS. 1 and 2, a circumferential groove 30 in each piston is illustrated, which groove is provided for the accommodation of at least an O-ring and possibly also of a split bearing which may be made of a suitable synthetic resin material, for example, DELRIN.

Figure 5:
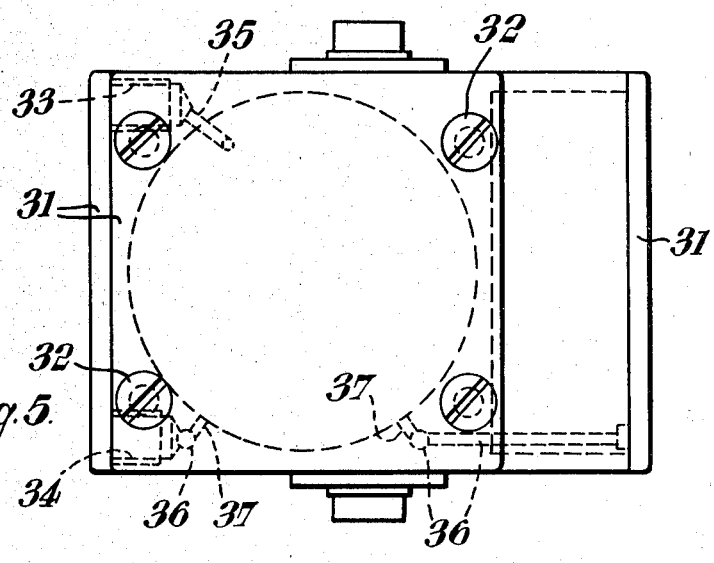

Each cylinder 11 has its open end closed by a cover plate 31 which is held in position by four screws or bolts 32 (FIG. 5).

Figure 4:
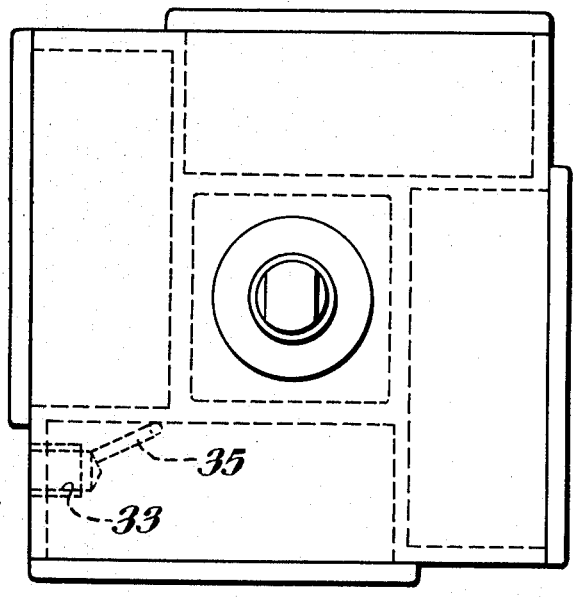
FIGS. 4 and 5 are plan and elevation views of the actuator, respectively.

Adjacent one of said plates 31 are two ports 33, 34 formed in the body 10 for the supply/exhaust of a pressurised fluid (for example, air at 100 p.s.i.). Each of said ports is internally threaded to facilitate a screwed connection of appropriate lines to the actuator. The port 33 is placed in fluid communication with the cuboid chamber 12 by means of a passageway which is illustrated in part and which is indicated by the reference numeral 35 (FIG. 4). The port 34 is placed in fluid communication with all of the cylinders on those sides of the respective pistons which are remote from the centre gear 16; this is achieved in a well-known manner, namely, by the provision of a series of inter connected drillings and shallow grooves which create a kind of "ring main" for the pressurised fluid being supplied to or the used fluid being exhausted from the four cylinders. Only a few drillings 36 and shallow grooves 37 are illustrated in FIG. 5 but the manner of providing them and their disposition will be obvious to a person skilled in the art. If necessary, the two shallow grooves 37 formed in the respective face of the body 10 and associated with each cylinder can be connected to one another by a groove in the inside face of the respective cover plate 31 (or by any other equivalent means), whereby the free flow of pressurised or used fluid is not interrupted when the pistons have been moved to the other ends of the respective cylinders from the respective ends at which the pistons are depicted in FIG. 1.

The operation of the actuator described above will be virtually self-evident and it will therefore suffice to say that, upon a pressurised fluid being supplied to the chamber 12 which houses the centre gear 16, the pistons 22 will simultaneously be forced outwardly along their respective cylinders 11, namely, from the positions thereof shown in FIG. 1 towards the respective cover plates 31. In being so displaced, said pistons will move their associated racks 24 and will therefore rotate the centre gear 16 through an arc of travel (e.g. 90°). This movement could be utilised to open a ball valve (not illustrated) whose stem has a recess which is complementary to that end of the output shaft 13 which has the two flats 17. As each rack 24 starts to move, the sloping wall 29 helps to prevent any contact between the web 23 of one piston/rack and the free end of the rack of another. The reverse operation is achieved by supplying pressurised fluid to those piston faces which are remote from the centre gear.

The pads which are inserted in the seats 21 therefor are provided to give support to the racks as they are displaced, in either direction, it being realised that the meshing teeth of the centre gear 16 and the racks 24 still have a tendency to separate.

Figure 8:
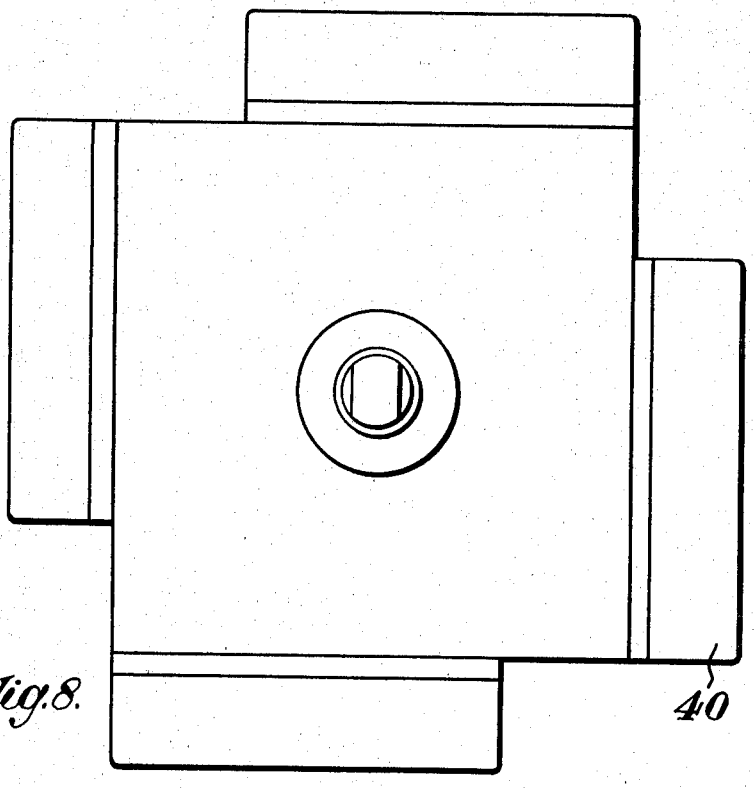
FIG. 8 is a plan view of a piston-rack rotary actuator according to the invention but of spring-return design.

Referring briefly to FIG. 8, as spring-return models of rotary actuators are well-known, it will only be necessary to say that it will be seen that the additional parts 40 housing the compression springs (not illustrated) do not significantly enlarge the actuator which is shown for example in FIG. 4. Moreover, the entire space within each part 40 can be utilised to accommodate, for example, helical compression springs which are nested one within the other, the convolutions of the several springs being prevented from rubbing against one another by cylindrical sleeves of appropriate diameters.

Instead of the through-passageways 27, deep recesses would be sufficient. In such a case, instead of the aperture whose extent is bracketed and is indicated by the reference numeral 50, there would be a thin wall. Such a recess would be the equivalent of the passageway 27.

One alternative, already mentioned before the detailed description of the drawings, could give rise to a different method of supporting the racks against displacement due to teeth separation. If, instead of the rack configuration shown in FIG. 8, there were to be an approximately Y-shaped web having two racks formed in corresponding faces of parallel limbs of the Y, pins could be provided for the interconnection of said limbs and respective parts of the body 10. In one arrangement the pins could be secured in the body and would extend parallel to one another into or through the spaced limbs; this would necessitate annular DELRIN bearings in said limbs. In another arrangement, said pins could be secured in the limbs and would extend into aligned passageways in the body, annular bearings being provided in said passageways.

The use of piston/racks arranged in a "square" around the centre gear has had the result of providing considerable compactness, and greatly increased power compared with any existing actuator of even approximately the same (but bigger) size. The simultaneous movements of the pistons in directions which are at right angles to one another coupled with the extension of the racks into one another (or around the sides of one another in the Y-shaped racks embodiment described in the preceding paragraph) has meant that it is possible to make the forces act directly along a line which extends approximately through the meshing teeth of the centre gear/racks. This, in turn, has meant that the cylinders for the pistons become very neatly arranged about the centre gear, and also that there is remarkably little "dead" space in the actuator.

Figure 9:
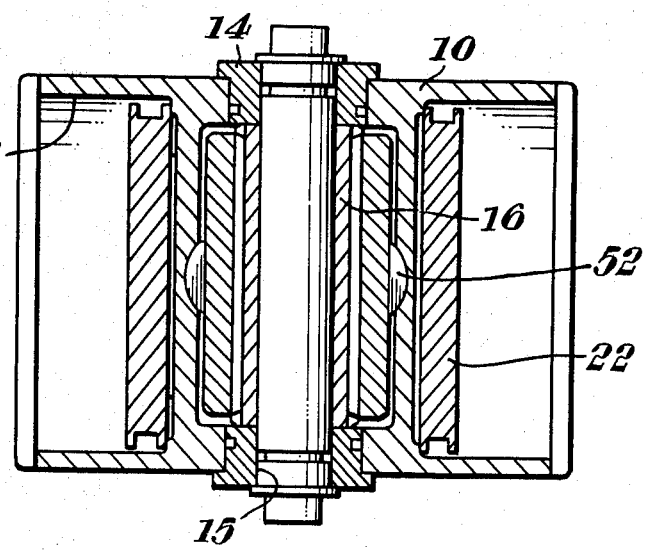
FIG. 9 is a view similar to that shown in FIG. 2 of one alternative embodiment of a double-acting piston-rack rotary actuator according to the present invention.
Figure 10:
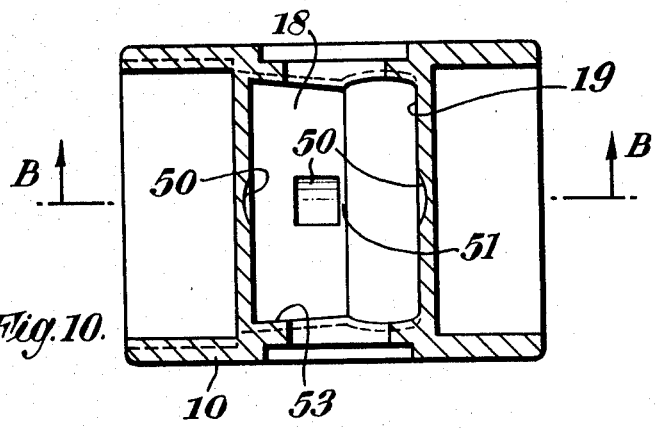
FIG. 10 is a view, similar to that shown in FIG. 3, of the casting for said alternative embodiment.
Figure 11:
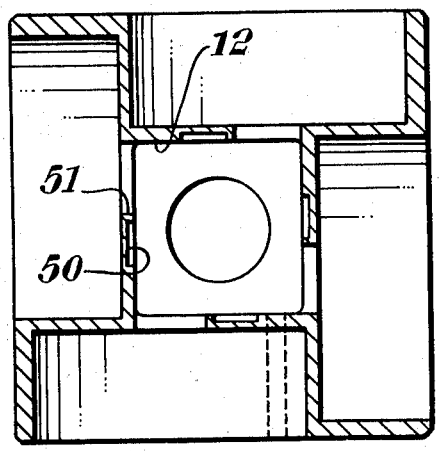
FIG. 11 is a section through said casting on the line B—B in FIG. 10.

The remarks made in the preceding paragraph are also true of the alternative embodiment which will now be described with reference to FIGS. 9 to 12 which illustrate certain parts of the actuator. In the following description, the same reference numerals as have been used in FIGS. 1 to 8 will be used to indicate identical or closely similar parts. The principal difference between the embodiment of FIGS. 9 to 12 compared with that of FIGS. 1 to 8 concerns the pad of a suitable synthetic resin material for the support of the web which is integral with each piston and which has the toothed rack formed therein. It has been considered desirable to provide, if possible, what could be called a self-aligning bearing for the back of the web 23 and this has been done by slightly altering the casting 10 and by providing a different seat for the pad in the wall 18. It will be seen from FIG. 10 that each wall 18 has a smaller opening 19 than was the case in the embodiment of FIGS. 1 to 8, and also that there is no longer the semi-circular extension 20 or the seat 21 for the pad 21. Instead, in FIGS. 9, 10 and 11, there is illustrated a shallow part-cylindrical seat 50 formed in each wall 18; the part-cylindrical shape of the seat 50 is clearly seen in FIGS. 9 and 10 and FIG. 11 shows that the seat 50 is bounded by a retaining web 51 on the side thereof which is nearer to the opening 19. Such an arrangement is considered to be less expensive to cast and subsequently to machine; the elimination of the extension 20 constitutes a desirable simplification. Moreover, the part-cylindrical shape of each of the seats 50 and the provision of complementary pads 52 (FIG. 9) in those seats has resulted in the meshing teeth of the rack 24 and the centre gear 16 being able to "settle down" into the optimum meshing configuration; by virtue of the complementary curvatures of the seats 50 and the pads 52, the pade 52 are able to rock, see-saw fashion, in the seats 50 and this ability enables the webs 23 of the pistons 22 to rock slightly about their respective longitudinal axes.

Figure 12:
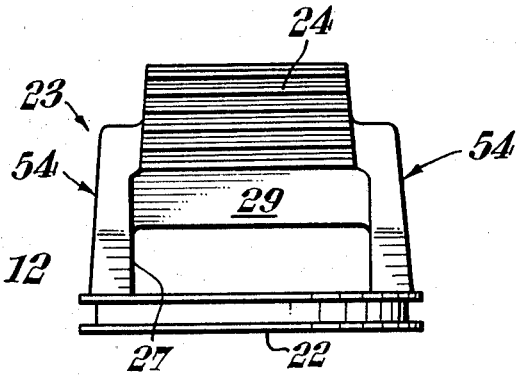
FIG. 12 is a view, similar to that shown in FIG. 7, of the combined piston/rack employed in said alternative embodiment.

Referring now to FIGS. 10 and 12, it will be seen that a frusto-conical taper 53 is imparted to the casting 10 where the web 23 will enter as the respective piston 22 moves centripetally. This taper 53 is complemented by a taper 54 which will be evident from a comparison of FIG. 12 with FIG. 7. The two tapers 53, 54 provide an end stop limiting inwards travel of the respective piston/rack. Moreover, the wall 28 of the piston/rack shown in FIG. 7 has been eliminated, with the result that the through-passageway 27 in FIG. 12 is deeper (viz. of greater dimension, measured along the longitudinal axis of the web 23) and extends up to the back face of the piston 22.

The slope of the wall 29 will preferably be 45°; however, said slope may fall within the range from 35° to 55° and the same remark applies to the slope of the wall 29 described above with reference to FIGS. 6 and 7.

It must be emphasised that, in any spring-return model of the two embodiments of the actuator hereinbefore described, the precise manner of achieving the centripetal movements of the pistons under spring power is not of any great importance per se. Other ways of providing spring-return exist and will suggest themselves to any competent person in this art.

Figure 14:
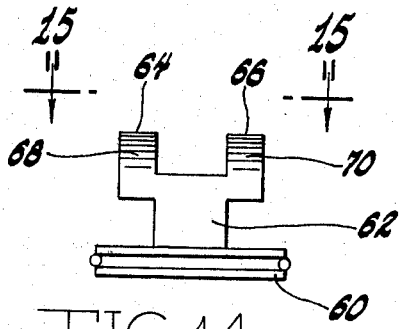
FIG. 14 is a front elevational view of yet another form of combined piston rack.
Figure 15:
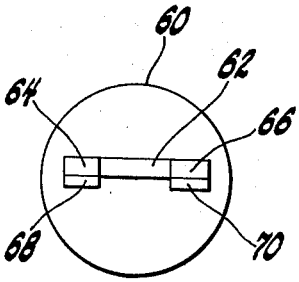
FIG. 15 is an end view taken along line 15—15 of FIG. 14.

FIGS. 14 and 15 show one form of a Y-shaped rack such as is described on Page 3, lines 21 et seq, and Page 8, last line et seq. As shown in FIGS. 14 and 15, piston 60 carries a rack having a centrally positioned web 62. The free end of the web is bifurcated to provide a pair of limb-like tines 64 and 66 which extend outwardly from web 62, and aligned toothed rack portions 68 and 70 are provided on the tines 64 and 66.

Tines 68 and 70 are spaced from each other, as viewed in FIG. 14, sufficiently to permit nesting of the tines and webs of the respectively adjacent rack members when arranged as indicated in FIGS. 1 and 13 with a web 62 of one rack passing between, being straddled by, the tines 68 and 70 of the next rack. In this form the rack portions are accommodated by the passageway in the webs provided in the portion of the webs adjacent the pistons.

In the form of FIGS. 14 and 15 the toothed portion of the racks are formed of two separate sections. However, they form functionally single tooth sections of the racks which sections mesh with gear 16 in the same manner as their equivalents.

I claim:

1. A piston-rack rotary actuator comprising a body (10) in which an output shaft (13) is supported for angular movements about its axis of rotation, wherein said shaft has a gear (16) intermediately of its ends, wherein pistons (22) having integral toothed racks (24) in mesh with said gear (16) are displaceable along the respective cylinders (11) in said body (10) under the influence of a pressurized fluid medium with resultant angular movement of the output shaft (13) about its axis of rotation;

characterized in;

that there are four pistons (22) arranged in serial order circumferentially around said gear each of which is accommodated in a respective one of four cylinders (11);

said pistons and said cylinders being arranged in two opposite pairs with respect to said gear and said pistons being arranged for simultaneous displacement radially of said gear along their said respective cylinders under the influence of said pressurized fluid medium;

that each one of the integral toothed racks (24) of said pistons meshes respectively with one portion of one of two sets of diametrically opposed teeth on said gear (16); and that pressurized fluid medium supply means (33 to 37) are provided to facilitate the supply of said medium to corresponding one or other faces of said pistons (22) simultaneously in order to move said pistons to simultaneously drive said gear while said pistons are moving in four different directions.

2. An actuator as claimed in claim 1, in which the longitudinal axes of the cylinders (11) are co-planar and are so disposed that each longitudinal axis of the four axes extends in a direction which makes a right angle with each adjacent one of said axes.

3. An actuator as claimed in claim 1 or 2, in which the toothed rack (24) of each piston (22) is formed in one face of a web (23) which has a through-passageway or recess (27) formed therein, whereby, when all of said pistons (22) have been moved centripetally with respect to said gear to the fullest extent possible, a portion of the rack (24) of each piston (22) including the free end of said rack is accommodated by said through-passageway or recess (27) in the web (23) of a respective other piston.

4. An actuator as claimed in claim 3, in which the body (10) supports a number of bearing pads (52) located in a corresponding number of seats (21,50), each of said pads being in contact at all times with a surface of the respective one of the four webs (23) in order to counteract the separating force generated when the respective piston (22) is displaced along its cylinder (11).

5. An actuator as claimed in claim 4, in which each bearing pad (52) is adjustable in its seat (50) in such a manner as to enable the teeth of the respective rack (24) and the centre gear (16) to mesh in optimum fashion by virtue of the web (23) being free to move angularly to a limited extent about its longitudinal axis.

6. An actuator as claimed in claim 3, in which the four cylinders (11) are grouped around a central cuboidal chamber (12) across which said shaft (13) and its integral said gear (16) extends and into which the webs (23) with their integral racks (24) extend, each piston (22) in its respective cylinder (11) being so positioned relatively to said gear (16) that the imaginary line extending at right angles to the plain face of the piston (22) through the centre of said face is tangential to or just cuts the respective teeth on said centre gear.

7. An actuator as claimed in claim 3, in which for each web (23) the teeth of the rack (24) have their roots on or closely adjacent to that diametral plane of the piston (22) to which said web is joined which is parallel to the planes which contain the corresponding inner faces of the two adjacent pistons (22) whose directions of movement are at right angles to that of said piston.

8. An actuator as claimed in claim 1 or 2, in which each piston has a web (62) having a free end extending from said piston, each web (62) is bifurcated in the region of its free end and each limb of the bifurcation is provided with toothed rack portions (68,70) which together constitute said toothed racks, and in which the bifurcated end region of another web (68,70) straddles the nonbifurcated free end region of each web (62) when all of the pistons (60) and their integral webs (62) have been moved centripetally to the fullest possible extent.

9. An actuator as claimed in claim 1 or 2 which each piston has a web having a free end extending from said piston, and said toothed racks are formed at the outward ends of said webs with each of said racks reciprocating across the line of force of a piston other than the one to which the respective said rack is connected.

10. An actuator as claimed in claims 1 or 2, in which the body (10) supports a number of bearing pads (52) located in a corresponding number of seats (21,50), each of said pads being in contact at all times with a surface of the respective one of the four webs (23) in order to counteract the separating force generated when the respective piston (22) is displaced along its cylinder (11).

11. An actuator as claimed in claims 1, or 2, in which the four cylinders (11) are grouped around a central cuboidal chamber (12) across which said shaft (13) and its integral said gear (16) extends and into which the webs (23) with their integral racks (24) extend, each piston (22) in its respective cylinder (11) being so positioned relatively to said gear (16) that the imaginary line extending at right angles to the plain face of the piston (22) through the center of said face is tangential to or just cuts the respective teeth on said center gear.

12. An actuator as claimed in claims 1 or 2, in which for each web (23) the teeth of the rack (24) have their roots on or closely adjacent to that diametral plane of the piston (22) to which said web is joined which is parallel to the planes which contain the corresponding inner faces of the two adjacent pistons (22) whose directions of movement are at right angles to that of said piston.

13. A piston-rack rotary actuator comprising:

a body (10) in which an output shaft (13) is supported for angular movements about its axis of rotation, wherein said shaft has a gear (16) intermediately of its ends, wherein pistons (22) having integral toothed racks (24) in mesh with said gear (16) are displaceable along respective cylinders (11) in said body (10) under the influence of a pressurized fluid medium with resultant angular movement of the output shaft (13) about the axis of rotation, characterised in that there are four pistons (22), each piston having a rack (24) drivingly engaging said gear (16);

each of said racks (24) on one of said pistons, extending through a rack of another piston;

with said cylinder, racks, and pistons, being closely nested around said gear.

14. The actuator as set forth in claim 13, wherein:

each said rack (22) passes tangentially across said gear, and across the path of movement of at least one other of said racks.

15. The actuator of anyone of claims 13 or 14, wherein:

each said rack extends perpendicularly across the line of movement of one other rack.

16. The actuator of anyone of claims 1, 2, 13 or 14, wherein:

the rack of each said piston extends substantially perpendicularly of and centrally of the working face of its associated piston.

* * * * *